United States Patent [19]

Leonard et al.

[11] 4,078,463

[45] Mar. 14, 1978

[54] METHOD AND APPARATUS FOR CUTTING SMALL SHAPED PIECES FROM STACKS OF COMPRESSIBLE SHEET INSULATING MATERIALS

[75] Inventors: Randal K. Leonard, Brighton; Reau Graves, Jr., Lakewood, both of Colo.

[73] Assignee: Frostline, Inc., Broomfield, Colo.

[21] Appl. No.: 768,552

[22] Filed: Feb. 14, 1977

[51] Int. Cl.[2] ..... B26D 7/14; B26D 7/02

[52] U.S. Cl. ..... 83/176; 83/453; 83/465; 83/466; 83/925 CC; 83/565

[58] Field of Search ..... 83/925 CC, 452, 453, 83/454, 465, 466, 176, 565

[56] References Cited

U.S. PATENT DOCUMENTS 3,730,634 5/1973 Gerber et al. ..... 83/925 CC X

*Primary Examiner*—Willie G. Abercrombie

*Attorney, Agent, or Firm*—Edwin L. Spangler, Jr.

[57] ABSTRACT

This invention relates to a novel apparatus for cutting mats of compressible insulation materials arranged in stacks into small intricately shaped pieces which comprises an elevatable platform which raises the stack and compresses same against the undersurface of a rigid pattern supported in spaced relation beneath an overhead framework on uprights which are rotatable and include an offset portion sized and positioned to receive that part of the fabric cutter overhanging the axis of upright rotation regardless of the position of the cutter adjacent the edge of the pattern. The invention also encompasses the novel method of cutting stacks of compressible sheet insulating materials which comprises the steps of elevating the stack into compressed relation beneath one or more patterns supported on rigid rotatable uprights having offset portions, cutting around each pattern with a fabric cutter while rotating the upright supporting same so that the offset therein accommodates that portion of said cutter overhanging the axis of the upright of rotation to free the shaped pieces from the stack, and releasing the stack thus cut.

14 Claims, 6 Drawing Figures

METHOD AND APPARATUS FOR CUTTING SMALL SHAPED PIECES FROM STACKS OF COMPRESSIBLE SHEET INSULATING MATERIALS

A good many insulated garments, sleeping bags, footwear and the like are filled with down while others use as insulating materials such things as cotton batting, kapok, various synthetic fibers and the like. Many of the latter insulating materials are sold in the form of thick compressible sheets or mats which must be precut to a particular size and shape before being sewn or otherwise fastened between the two layers of fabric which will ultimately cover same, both inside and out. Cutting these thick compressible mats, especially more than one at a time, poses certain problems that do not admit to an easy solution. The biggest problem, however, arises when one attempts to cut small intricately shaped pieces therefrom using a standard self-contained electric powerd fabric cutting tool. The latter problem exists regardless of whether a single sheet or a stack thereof is being cut because, ordinarily, the means used to hold the pattern down tightly against the sheet or stack as the case may be ends up interfering with the movement of the cutting tool in certain positions.

Another troublesome problem in such an operation as that previously described is the inordinately long set-up time usually required to arrange and fasten down the patterns for cutting different shaped pieces. It is not uncommon, for example, to cut enough pieces to make, say a dozen to a hundred finished articles in a single operation taking, perhaps, only a few minutes. At this rate, a sizable inventory can be built up in a short period of time on a given item and, therefore, it becomes necessary to change the set up so that a different size of the same article or a different one altogether can be cut. It is not uncommon to find that the set-up time required to change over to a different product or even a different size in the same product exceeds the cutting time.

It has now been found in accordance with the teaching of the instant invention that these and other shortcomings of the prior art methods and equipment for cutting stacks of compressible insulating materials into small intricately shaped pieces can, in large measure, be eliminated through the use of an elevatable platform adapted to raise the stack and compress it against supported beneath an overhead grid on rigid rotatable uprights which have offset portions positioned and adapted to receive those parts at the cutter that overhang the axis of upright rotation in moving along the edge of the pattern. These uprights remain free to rotate relative to both the pattern on the lower end thereof and the grid thereabove while, at the same time, providing the necessary rigidity to resist the stack of compressed mats being forced thereagainst by the elevatable platform. Overlying the platform in fixed spaced relation underneath a frame lies a lattice work grid, the lattice of which cooperates with novel quick-disconnect couplings on top of each upright. These couplings include portions sized and shaped to pass through the grid yet, upon rotation an eighth of a turn or so, they lock onto the latter so as to prevent further movement normal to the surface of the grid while, at the same time, permitting limited movement in a plane parallel thereto.

As far as the prior art methods for cutting sheets of compressible insulating materials are concerned, the instant one constitutes a considerable improvement thereover in reducing the set-up time to a near minimum level while permitting small intricate pieces to be cut accurately with standard fabric cutting machines. One key feature of the method is that of swinging the pattern supports out of the way of the cutter whenever it encrouches upon the latter during the excursion of the cutter around the pattern without, in so doing, removing the support therefrom. Another feature is to maintain the stack in compressed relation while being cut by squeezing same between the elevatable platform and the patterns supported in fixed spaced relation beneath a grid held in superimposed position overhead. These same elements cooperate with one another to maintain the pattern supports in adjusted position within the grid lattice while the pieces are being cut.

It is, therefore, the principal object of the present invention to provide a novel and improved apparatus for cutting sheets of compressible materials into small intricately shaped pieces using conventional electric fabric cutters.

A second objective is the provision of an improved method for quickly and easily cutting one sheet or a stack of compressible mats and the like into separate parts regardless of shape or size within certain limits.

Another object is to provide a cutting machine of the type aforementioned that is readily adapted for use in cutting many different kinds of sheet materials, especially those that are otherwise most difficult to cut up into small pieces like thick compressible insulating material mats.

Still another objective is the provision of a fabric cutting method which is ideally suited for use in those operations which require repeated set-ups and take-downs to accommodate different shapes and sizes of patterns.

An additional object of the within described method and apparatus is to provide those which are particularly well suited to the cutting of small intricate parts out of thick mats, sheets or batts of insulating material of the type used in outerwear, sleeping bags and the like.

Further objects are to provide a fabric cutting apparatus which is simple, efficient, easy to operate, versatile, relatively inexpensive, rugged, reliable, compact and even somewhat decorative in appearance.

Other objects will be in part apparent and in part pointed out specifically hereinafter in connection with the description of the drawings that follows, and in which.

Figure 1:
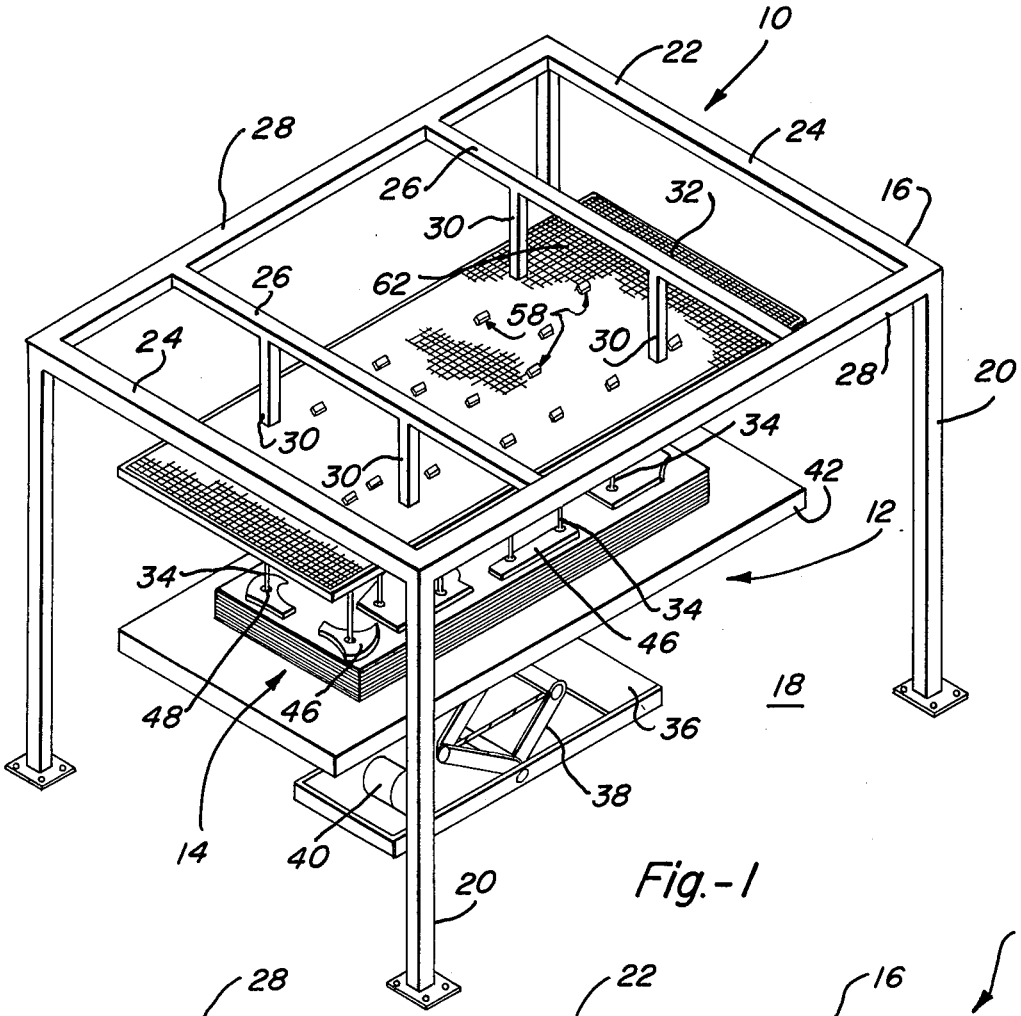
FIG. 1 is a perspective view of the apparatus used to hold the stack of compressible sheets in place against the patterns while being cut.
Figure 2:
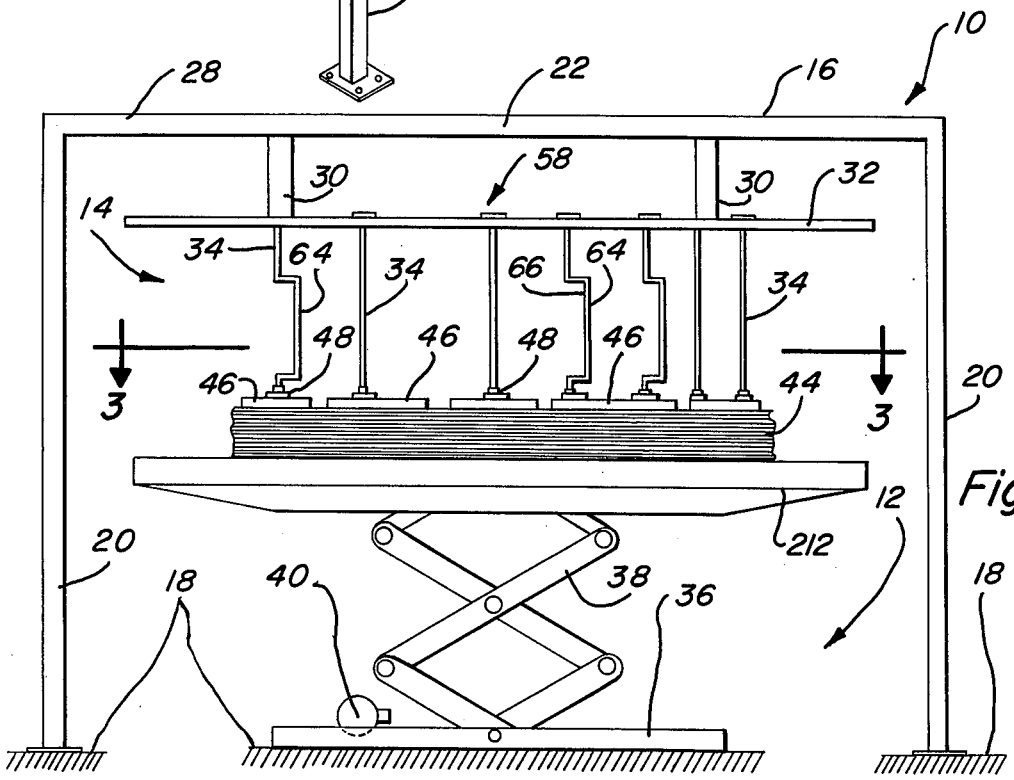
FIG. 2 is a side elevation thereof.
Figure 3:
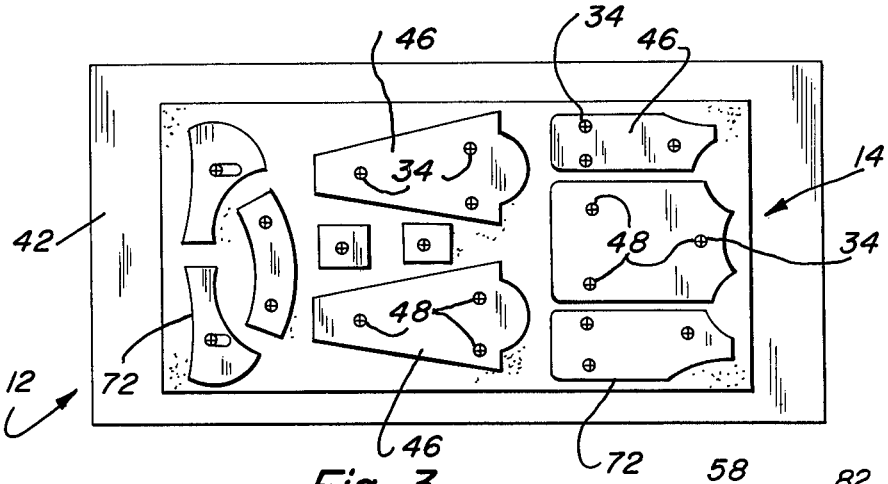
FIG. 3 is a section taken along line 3—3 of FIG. 2.

Referring next to the drawings for a detailed description of the present invention and, initially, to FIGS. 1, 2 and 3 for this purpose, reference numeral 10 has been chosen to represent the apparatus in its entirety while numerals 12 and 14 have been similarly employed to designate key subassemblies thereof, specifically, the elevatable platform subassembly and the pattern support subassembly, respectively. In the particular form illustrated, an open frame 16 is mounted in freestanding relation atop a suitable horizontal supporting surface 18. The frame includes cornerposts 20 fastened to the supporting surface and a generally rectangular subframe 22 supported atop the latter in essentially horizontal relation. Spaced inwardly of the ends 24 of the subframe are a pair of longitudinally-spaced substantially parallel crossframe members 26 extending between the sides 28 to which they are attached. Each of these crossframe members has a pair of vertically-disposed posts 30 extending downwardly from the underside thereof in transversely-spaced substantially parallel relation to one another which cooperate with the overhead member from which they hang to define what has become known as a "twin-tie" shaped structure.

Suspended beneath subframe 22 on these four crossframe posts 30 is a laticed grid 32 which parallels supporting surface 18 as shown in FIG. 2. This grid is an important feature of the instant invention because it detachably and adjustably mounts the uprights 34 of the pattern support subassembly 14 which will be described in detail presently. Before doing so, however, it will be advisable to first describe the elevatable platform subassembly 12 which is revealed in these same first three figures of the drawings.

Resting atop supporting surface 18 within the area thereof bounded by the posts 20 of the frame 16 is a base 36 upon which is mounted elevating mechanism 38 and the drive therefor, 40. In the particular form illustrated, elevating mechanism 38 comprises nothing more than a conventional scissor jack powered by an electric motor 40. Here, of course, any number of different conventional elevating mechanisms could, without the exercise of invention, be used to raise and lower platform 42.

Now, piled one on top of the other on platform 42 are a plurality of sheets or mats of compressible material to form a stack 44 thereof. At present, the apparatus is being used to hold several mats of insulating materials such as those made of kapok, glasswool, synthetic fibers and the like although, as pointed out previously, it can be used with other sheet materials. It does, however, offer many advantages in solving the problems associated with the cutting of thick compressible sheets of insulating material up into small intricately shaped pieces that are not, for instance, solved by the prior art methods and equipment for cutting ordinary fabrics or even insulating materials into large regularly shaped pieces.

Now, the function of the elevatable platform subassembly 12 is to raise stack 44 up and compress it tightly against the undersurfaces of patterns 46 which are carried on the lower ends of uprights 34 as shown. FIG. 3 is representative of the intricately shaped patterns that can be cut with the method and apparatus of the present invention, the one shown constituting the insulation for a jacket with a high turtleneck style collar and long sleeves.

Next, with particular reference to FIGS. 1–4, inclusive, and especially the latter, it will be seen that each pattern 46 is rigid and has fastened to the top surface thereof at least one, and oftentimes several, journals 48, each of which receive the lower end of an upright 34 for rotational movement about a substantially vertically-disposed axis. In the particular form shown in FIG. 4, journal 48 includes a marginally flanged housing 50 shown bolted to the pattern and having a cylindrical socket 52 therein for ball bearing 54.

The upper end of upright 34 is similarly journalled for rotation about the same vertical axis in the sleeve bearing 56 of a novel coupling which has been broadly designated by reference numeral 58. Bearings 54 and 56 are, of course, arranged one above the other in vertically-spaced coaxial relation as shown. While it is by no means essential it is, nonetheless, convenient to leave journal 48 and its pattern 46 readily detachable from the upright 34 and, perhaps its coupling 58 as well so that both the upright and coupling can be used with other patterns. In so doing, the elevatable platform can be raised to a level which is sufficient to maintain the pattern support subassemblies 14 in assembled relation even though the patterns are not in final position atop the stack nor is the latter compressed to the degree it needs to be for cutting. With the stack just lightly compressed to the extent required to maintain the pattern support subassemblies in assembled relation, the pattern can still be moved over the surface of the stack and its coupling can be adjusted within the confines of the opening 60 (FIGS. 4 and 6) in the lattice 62 as indicated by broken lines in FIG. 6 to maintain the axis of upright rotation at right angles to the surface of the stack.

Apart from the rotatability of upright 34, the other single most important feature is the offset portion 64 thereof which defines the recess 66 positioned and shaped to receive that portion 68 of the cutter 70 (shown in phantom lines in FIG. 4) which overhanges the axis of upright rotation whenever the distance from said axis to the edge 62 of the pattern along which the blade 74 is running in less than the distance separating said blade and such overhanging portion. Upright 64 being fully rotatable can, of course, accommodate the overhanging portion 68 of the cutter 70 regardless of where it is along the edge of the pattern. In fact, on extremely small patterns, offset portion 64 of the upright may itself project beyond the edge of the pattern yet, even if it does, it still will not interfere with movement of the cutter very close to the axis of upright rotation.

Figure 4:
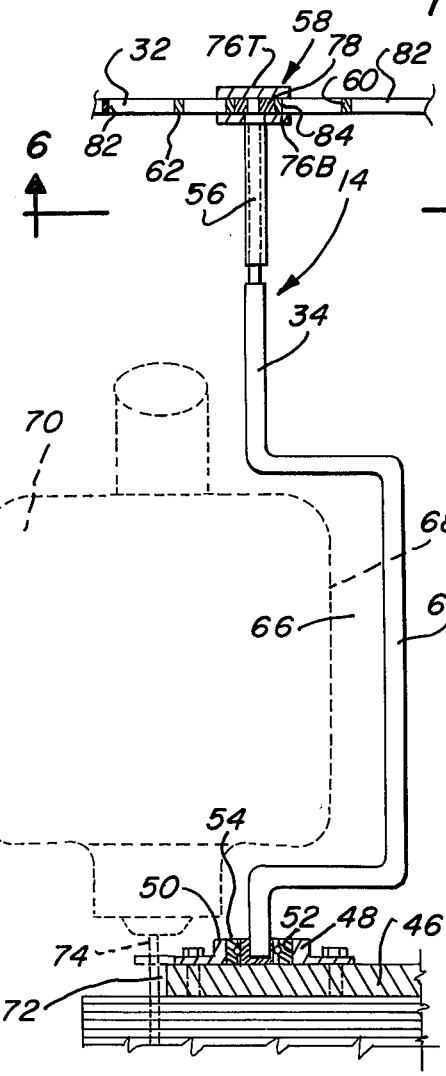
FIG. 4 is a fragmentary detail to an enlarged scale and with portions broken away and shown in section illustrating one of the pattern support subassemblies.

Lastly, with particular reference to FIGS. 1, 2, 4, 5 and 6, it will be seen that coupling subassembly 58 is of the limitedly rotatable quick-connect, quick-disconnect type. In the particular form shown, the openings 60 in the lattice 62 of grid 32 are rectangular although, obviously, they could be of other geometric shapes. Centrally positioned atop sleeve bearing 56 and rigidly fastened thereto are a pair of rectangular plates 76T and 76B held in fixed-spaced parallel relation to one another by stop-forming spacer 78 located therebetween. Plates 76 are shaped to pass through the opening 60 in the lattice when properly oriented relative thereto but also to project beyond at least two opposed margins thereof when rotated as shown. To do so, of course, one dimension of the plates must be greater than one dimension of the opening or hole 60 into which it passes. Likewise, the spacing between plates must be great enough to accommodate the thickness of the lattice as shown in FIG. 4.

Figure 6:
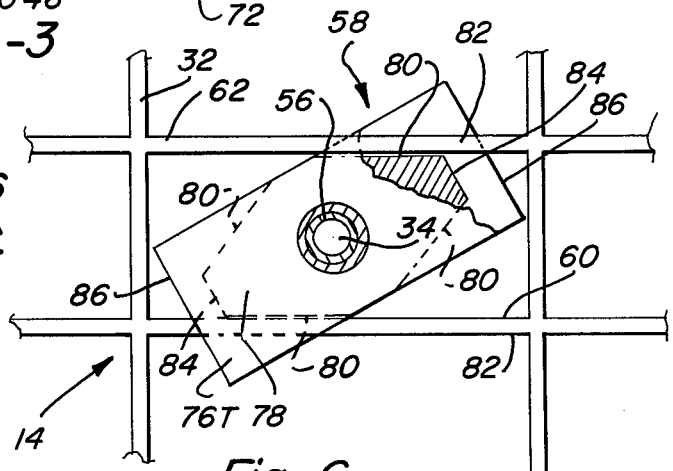
Figure 5:
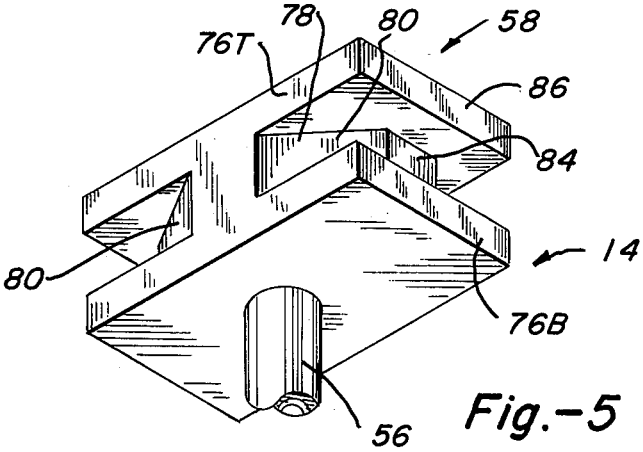
FIG. 5 is a still further enlarged fragmentary perspective view of the rotatable coupling atop the upright of the pattern support subassembly; and, FIG. 6 is a section taken along line 6—6 of FIG. 4 to a scale larger than the latter but smaller than that of FIG. 5.

Stop-forming spacer 78, in the particular form illustrated, has the corners 80 thereof truncated to engage the intersecting elements 82 of the lattice 62 and limit the angle of rotation of the coupling when rotating from its released into its latched position shown in full lines in FIG. 6. Here again, truncated edges 80 could be rounded instead of being straight as shown although no useful purpose would be served by so doing.

The ends 84 are also cut back and recessed behind the corresponding ends 86 of the plates so as to provide the coupling with limited movement from end-to-end of rectangular opening 60 in the lattice. Similar provision could, of course, be made for limited side-to-side movement if desired.

What is claimed is:

1. For use in combination with a motorized fabric cutter of the type having portions overhanging the edge of the pattern when the blade lies adjacent the edge thereof, the improved apparatus for holding the pattern against the fabric while the latter is being cut which comprises: stationary and movable planar elements arranged one above the other in spaced substantially parallel relation, means defining a frame attached to said stationary planar element supporting same in fixed position above said movable planar element, elevator means connected to the movable planar element operative upon actuation to raise and lower same relative to said stationary element while maintaining the parallel relationship therebetween, and pattern support means having an upper end detachably connectable to the stationary planar element and a lower end attachable to a pattern for rotational movement about a mutually perpendicular axis extending therebetween, said support means cooperating with the stationary planar element to maintain the pattern in position above a stack of fabric sheets elevated thereagainst on the movable planar element upon actuation of the elevator means in a direction to raise same, and said support means having an offset portion intermediate the ends thereof cooperating therewith to define a side opening notch sized and positionable upon rotation thereof to receive those portions of the cutter that overhang the edge of the pattern and intersect the axis of support rotation irrespective of the location of said cutter around said pattern.

2. The improved apparatus as set forth in claim 1 wherein at least two pattern support means are used to support at least one pattern.

3. The improved apparatus as set forth in claim 1 wherein the frame means supports the stationary planar element in fixed spaced relation therebeneath, said stationary element comprises lattice-forming grid having openings therein of a uniform shape and size, and each pattern support means includes a connector on the upper end thereof journalling same for rotational movement, said connector being shaped and sized to pass axially through the openings in the grid when oriented in certain positions relative thereto and to releasably latch therein against axial movement upon limited rotational movement in at least one direction from one of said certain positions while within said opening.

4. The improved apparatus as set forth in claim 1 wherein the pattern support means includes a second connector on the lower end thereof journalling same for rotational movement, said second connector being attachable to a pattern.

5. The improved apparatus as set forth in claim 1 wherein the elevator means is operative upon actuation in a direction to elevate same to coact with the frame means, stationary planar member and pattern support means to compress a stack of compressible sheet materials supported atop the movable planar element against the underside of a pattern carried on the lower end of said support means therefor.

6. The improved apparatus set forth in claim 1 wherein the pattern support means includes connectors on both the upper and lower ends thereof mounted for rotational movement relative thereto and independent rotational movement relative to one another.

7. The improved apparatus as set forth in claim 1 wherein the pattern support means comprise a rigid rod having coaxially disposed opposite end portions interconnected by a generally C-shaped section therebetween.

8. The improved apparatus as set forth in claim 1 wherein the frame includes a horizontally-disposed subframe supported and superimposed above the stationary planar element by spaced uprights providing access to the movable planar element and workpieces stacked thereon.

9. The improved apparatus as set forth in claim 3 wherein the grid openings and the connectors on the upper ends of the pattern support means are both rectangular.

10. The improved apparatus as set forth in claim 3 wherein the openings in the grid are bordered on all sides by elements cooperating to define frames enclosing the latter, and the connectors on the upper end of each pattern support means include oppositely-opening slots in the sides thereof sized and positioned to receive opposed frame forming elements of the grid upon limited rotational movement of said connectors within said openings.

11. The improved apparatus as set forth in claim 3 wherein the connector moves into latched position upon limited rotational movement in either direction.

12. The improved apparatus as set forth in claim 6 wherein at least one connector is attached to the pattern support means for axial as well as rotational movement.

13. The improved apparatus as set forth in claim 9 wherein the connectors are shorter than the openings so as to permit limited relative horizontal adjustment of the former within the confines of the latter.

14. The improved apparatus as set forth in claim 10 wherein the slotted connectors along with the grid openings are rectangular and said connectors are slotted on all four corners and at both ends.

* * * * *